United States Patent [19]

Evans et al.

[11] Patent Number: 4,695,287

[45] Date of Patent: Sep. 22, 1987

[54] CYAN DYE-DONOR ELEMENT USED IN THERMAL DYE TRANSFER

[75] Inventors: Steven Evans, Rochester; Kin K. Lum, Webster, both of N.Y.

[73] Assignee: Eastman Kodak Company, Rochester, N.Y.

[21] Appl. No.: 911,839

[22] Filed: Sep. 26, 1986

Related U.S. Application Data

[63] Continuation-in-part of Ser. No. 813,209, Dec. 24, 1985, abandoned.

[51] Int. Cl.[4] ..... B41M 5/26

[52] U.S. Cl. ..... 8/471; 427/146; 427/256; 428/195; 428/207; 428/411.1; 428/480; 428/913; 428/914; 430/945

[58] Field of Search ..... 8/470, 471; 428/195, 428/207, 913, 914, 411.1, 480, 488.1, 488.4; 430/945; 427/146, 256

[56] References Cited

FOREIGN PATENT DOCUMENTS 0147747 7/1985 European Pat. Off. ..... 428/195

60-239289 11/1985 Japan ..... 8/471

*Primary Examiner*—Bruce H. Hess

*Attorney, Agent, or Firm*—Harold E. Cole

[57] ABSTRACT

A cyan dye-donor element for thermal dye transfer comprises a support having thereon a cyan dye dispersed in a polymeric binder, the cyan dye comprising a 2-carbamoyl-4-[N-(p-substituted aminoaryl)imino]-1,4-naphthoquinone.

In a preferred embodiment, the cyan dye has the formula

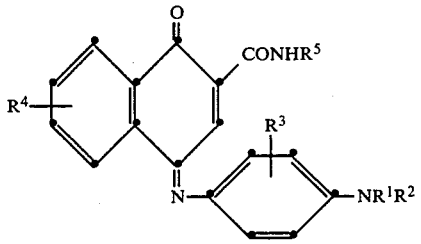

wherein $R^1$, $R^2$, and $R^5$ are substituted or unsubstituted alkyl, cycloalkyl, or aryl; and $R^3$ and $R^4$ are hydrogen; substituted or unsubstituted alkyl; halogen; —$NHCOR^1$ or —$NHSO_2R^1$.

20 Claims, No Drawings

CYAN DYE-DONOR ELEMENT USED IN THERMAL DYE TRANSFER

This invention relates to cyan dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide cyan dyes which have good light stability and have improved hues.

European patent application 147,747 relates to a dye-receiving element for thermal dye transfer printing. It also has a general disclosure of dyes for dye-donor elements useful therewith. Included within this general disclosure is a description of an indoaniline dye produced by the oxidation coupling reaction of a p-phenylenediamine derivative with phenol or naphthol. No specific naphthol compounds are illustrated.

Substantial improvements in light stability and hues are achieved in accordance with this invention which comprises a cyan dye-donor element for thermal dye transfer comprising a support bearing a dye layer comprising a cyan dye dispersed in a polymeric binder, said cyan dye comprising a 2-carbamoyl-4-[N-(p-substituted aminoaryl)imino]-1,4-naphthoquinone.

In a preferred embodiment of the invention, the cyan dye has the following formula

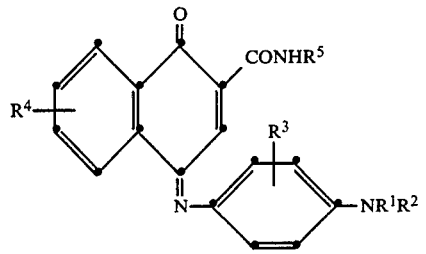

wherein $R^1$, $R^2$, and $R^5$ are substituted or unsubstituted alkyl of from 1 to about 6 carbon atoms such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; substituted or unsubstituted cycloalkyl of from 5 to about 7 carbon atoms such as cyclohexyl, cyclopentyl, etc.; substituted or unsubstituted aryl of from about 5 to about 10 carbon atoms such as phenyl, pyridyl, naphthyl, p-tolyl, p-chlorophenyl, m-(N-methyl sulfamoyl)phenyl, etc.; and $R^3$ and $R^4$ are hydrogen; substituted or unsubstituted alkyl of from 1 to about 6 carbon atoms such as methyl, ethyl, propyl, isopropyl, butyl, pentyl, hexyl, methoxyethyl, 2-cyanoethyl, benzyl, 2-hydroxyethyl, 2-methanesulfonamidoethyl, etc.; halogen such as chlorine, bromine, or fluorine; —$NHCOR^1$ or —$NHSO_2R^1$.

Compounds included within the scope of the invention include the following:

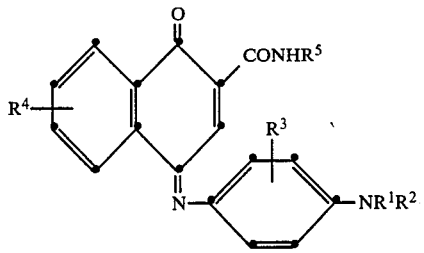

| Compound No. | $R^1$ | $R^2$ | $R^3$ | $R^4$ | $R^5$ |
|---|---|---|---|---|---|
| 1 | $C_2H_5$ | $C_2H_5$ | H | H | $CH_3$ |
| 2 | $C_2H_5$ | $C_2H_5$ | 2-$CH_3$ | H | $CH_3$ |
| 3 | $C_2H_5$ | $C_2H_5$ | 2-$CH_3$ | H | n-$C_4H_9$ |
| 4 | —$CH_2CH_2NHSO_2CH_3$ | $C_2H_5$ | 2-$CH_3$ | H | —$CH_2C_6H_5$ |
| 5 | —$CH_2CH_2OCH_3$ | $C_2H_5$ | 2-$CH_3$ | H | $CH_3$ |
| 6 | $C_2H_5$ | $C_2H_5$ | 2-$CH_3$ | 5-$NHSO_2CH_3$ | $C_2H_5$ |
| 7 | $CH_3$ | $CH_3$ | H | H | $C_6H_5$ |
| 8 | —$CH_2CH_2OH$ | $C_2H_5$ | 2-$CH_3$ | H | $CH_3$ |

-continued

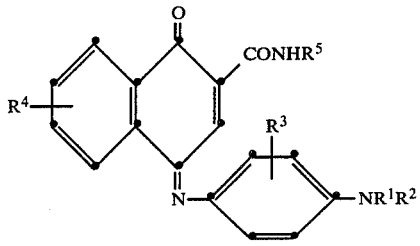

| Compound No. | $R^1$ | $R^2$ | $R^3$ | $R^4$ | $R^5$ |
|---|---|---|---|---|---|
| 9 | $C_2H_5$ | $C_2H_5$ | $-NHC(=O)CH_3$ | H | $CH_3$ |
| 10 | $C_2H_5$ | $C_2H_5$ | H | H | $CH_3$ |
| 11 | $C_2H_5$ | $C_2H_5$ | H | H | t-$C_4H_9$ |
| 12 | $C_2H_5$ | $C_2H_5$ | H | H | $-CH_2C_6H_5$ |
| 13 | $C_2H_5$ | $C_2H_5$ | H | H | $-C_6H_{11}$(ring) |
| 14 | $C_2H_5$ | $C_2H_5$ | 2-$CH_3$ | 5-$NHSO_2CH_3$ | $CH_3$ |
| 15 | $C_2H_5$ | $C_2H_5$ | 2-$CH_3$ | H | $C_6H_5$ |
| 16 | $C_2H_4OH$ | $C_2H_5$ | 2-$CH_3$ | H | $CH_3$ |
| 17 | $C_2H_4OH$ | $C_2H_5$ | 2-$CH_3$ | H | $CH_2CH_2OCH_3$ |
| 18 | $CH_2CH_2NHSO_2CH_3$ | $C_2H_5$ | 2-$CH_3$ | H | $CH_3$ |
| 19 | $C_2H_5$ | $C_2H_5$ | 2-$CH_2CH_2-NHSO_2CH_3$ | H | $CH_3$ |

A dye-barrier layer may be employed in the dye-donor elements of the invention to improve the density of the transferred dye. Such dye-barrier layer materials include hydrophilic materials such as those described and claimed in application Ser. No. 934,969 entitled "Dye-Barrier and Subbing Layer for Dye-Donor Element Used in Thermal Dye Transfer" by Vanier, Lum and Bowman, filed Nov. 25, 1986.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the cyan dye thereon as described above or may have alternating areas of other different dyes, such as sublimable magenta and/or yellow and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, yellow and the cyan dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A cyan dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.33 g/m$^2$), (2) Dye layer containing a cyan dye as identified below (0.27 g/m$^2$) in cellulose acetate hydrogen phthalate (0.41 g/m$^2$) coated from an acetone/2-butanone/cyclohexanone solvent.

On the back side of the element, a slipping layer of poly(vinyl stearate) (0.76 g/m$^2$) in cellulose acetate butyrate (0.33 g/m$^2$) was coated from tetrahydrofuran solvent.

(B) A second cyan dye-donor element was prepared by coating the following layers in the order recited on a 6 μm poly(ethylene terephthalate) support:

(1) Dye-barrier layer of gelatin nitrate (gelatin and cellulose nitrate in approximately 2:1 weight ratio in a solvent of primarily acetone and methanol) (0.20 g/m$^2$) coated from an acetone and water solvent, (2) Dye layer containing a cyan dye as identified below (0.37–0.38 g/m$^2$) in cellulose acetate (0.41–0.43 g/m$^2$) coated from an acetone/2-butanone/cyclohexanone solvent.

On the back side of the element, a slipping layer of poly(vinyl stearate) (0.31 g/m$^2$) in cellulose acetate butyrate (0.46 g/m$^2$) was coated from tetrahydrofuran solvent.

The following cyan dyes were evaluated:

Compound 1

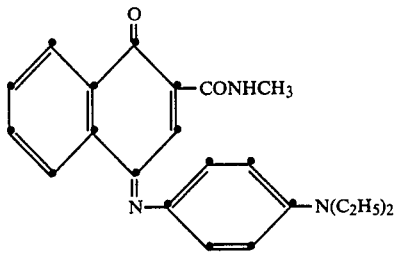

Compound 2

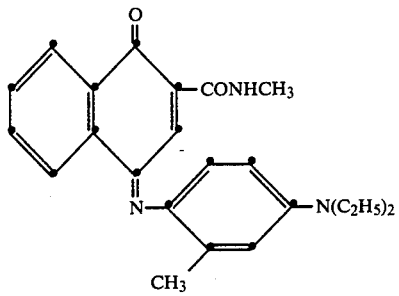

Control Compound 1

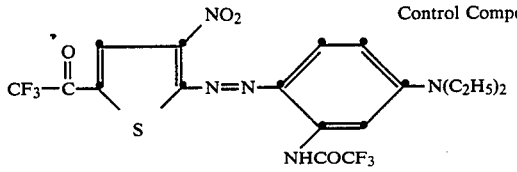

Control Compound 2

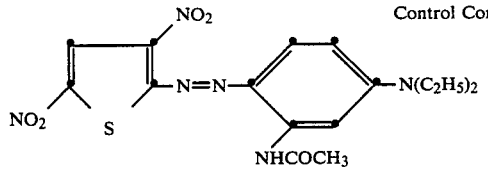

Control Compound 3

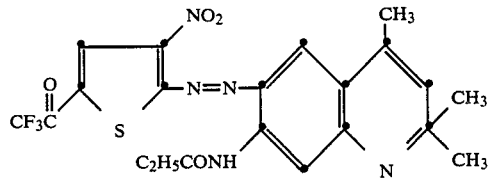

-continued

Control Compound 4

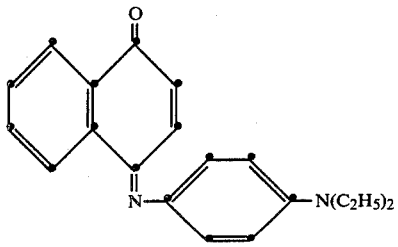

Dye-receiving elements were prepared by coating a solution of Makrolon 5705® (Bayer A. G. Corporation) polycarbonate resin (2.9 g/m$^2$) in a methylene chloride and trichloroethylene solvent mixture on an ICI Melinex 990® white polyester support for density evaluations or on a transparent poly(ethylene terephthalate film suppport for spectral absorption evaluations.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

The dye-receiving element was separated from the dye-donor element and the Status A red reflection density of the step image was read. The image was then subjected to "HID-fading": 4 days, 50 kLux, 5400° K., 32° C., approximately 25% RH. The density loss at a density near 1.0 was calculated.

The following dye stability data were obtained:

TABLE 1

| Dye | Donor Format | ΔD (at initial 1.0 density) |
|---|---|---|
| Compound 1 | B | −0.07 |
| Compound 2 | B | −0.07 |
| Control 1 | A | −0.27 |
| Control 2 | A | −0.46 |
| Control 3 | A | −0.62 |
| Control 4 | A | −0.22 |

Use of the compounds in accordance with the invention showed superior light stability as compared to a variety of control dyes.

The light absorption spectra from 400 to 700 nm were also obtained after transfer of an area of the dye to the transparent support receiver in the manner indicated above. From a computer normalized 1.0 density curve, the λ-max, and HBW (half-band width=width of the dye absorption envelope at one-half the maximum dye density) were calculated. The following results were obtained:

TABLE 2

| Dye | λ-max | HBW |
|---|---|---|
| Compound 1 | 669 | 137 |
| Compound 2 | 686 | 107 |
| Control 1 | 622 | 121 |
| Control 2 | 641 | 121 |
| Control 3 | 653 | 107 |
| Control 4 | 597 | 132 |

The dyes of the invention are of good cyan hue and all have λ-max's in the desired region of beyond 660 nm. The control dyes have λ-max's at shorter wavelengths or pronounced shoulders on the short wavelength side of the spectral curves and thus tend to look too blue.

EXAMPLE 2

(A) A cyan dye-donor element was prepared by coating the following layers in the order recited on a 6 μm poly(ethylene terephthalate) support:

(1) Dye-barrier layer of poly(acrylic)acid (0.16 g/m$^2$) coated from water, and (2) Dye layer containing a cyan dye as identified in Table 3 below (0.77 mmoles/m$^2$) in a cellulose acetate (40% acetyl) binder (1.2 g/g of dye) coated from a 2-butanone solvent.

On the back side of the element was coated a slipping layer the type disclosed in copending U.S. patent application Ser. No. 925,949 of Vanier et al, filed Nov. 3, 1986.

Dye-receiving elements were prepared as in Example 1.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at increments from 0 up to 8.3 msec to generate a graduated density test pattern. The voltage supplied to the print head was approximately 21 v representing approximately 1.7 watts/dot (12 mjoules/dot).

The dye-receiving element was separated from the dye-donor element and the Status A red reflection density of the step image was read. The image was then subjected to "HID-fading": 7 days, 50 kLux, 5400° K., 32° C., approximately 25% RH. The % density loss at maximum density was calculated.

The following dye stability data were obtained:

TABLE 3

| Dye | % Density Loss From D-max |
|---|---|
| Compound 10 | 8 |
| Compound 11 | 9 |
| Compound 12 | 10 |
| Compound 13 | 8 |
| Compound 14 | 6 |
| Compound 15 | 5 |
| Compound 16 | 8 |
| Compound 17 | 9 |

TABLE 3-continued

| Dye | % Density Loss From D-max |
|---|---|
| Compound 18 | 8 |
| Compound 19 | 25 |
| Control 4 | 14 |

With the exception of Compound 19, the cyan dyes of the invention show superior light stability as compared to the control compound.

The light absorption spectra were obtained and the λ-max and HBW were obtained as in Example 1 with the following results:

TABLE 3

| Dye | λ-max (nm) | HBW (nm) |
|---|---|---|
| Compound 10 | 669 | 137 |
| Compound 11 | 654 | 127 |
| Compound 12 | 662 | 128 |
| Compound 13 | 655 | 128 |
| Compound 14 | 697 | 138 |
| Compound 15 | 705 | 142 |
| Compound 16 | 687 | 134 |
| Compound 17 | 684 | 129 |
| Compound 18 | 659 | 139 |
| Compound 19 | 680 | 128 |
| Control 4 | 597 | 132 |

The cyan dyes of the invention are of good cyan hue and each has λ-max beyond 650 nm. The control dye had a λ-max less than 600 nm and thus tends to look too blue.

EXAMPLE 3

Preparation of Compound 1

N-(p-diethylamino)phenyl-2-(N-methyl)carbamoyl-1,4-naphthoquinone

A solution of 2-(N-methylcarbamoyl)-1-naphthol (20.1 g, 0.1 mole) in 1000 mL ethyl acetate was mixed with a solution of N,N-diethyl-p-phenylenediamine hydrochloride (20.1 g, 0.1 mole) in 500 mL of distilled water. The two-phase system was rapidly stirred while solid sodium carbonate (106 g, 1.0 mole) was added in portions. Then a solution of 164.5 g (0.5 mole) potassium ferricyanide in 500 mL distilled water was added dropwise over 30 minutes. The reaction was stirred 16 hours at room temperature and then filtered through a pad of diatomaceous earth.

The filtrate was transferred to a separatory funnel, the layers separated and the organic phase washed three times with distilled water. The organic phase was dried over magnesium sulfate and passed over a short (3 inch diameter×2 inch height) column of silica gel (Woelm TSC) and evaporated to dryness. Crystallization of the crude product from 260 mL of methanol yielded 28.5 g (78.9% of theory) of a blue solid, m.p. 127°–128° C.

The invention has been described in detail with particular reference to preferred embodiments thereof, but it will be understood that variations and modifications can be effected within the spirit and scope of the invention.

What is claimed is:

1. A cyan dye-donor element for thermal dye transfer comprising a support bearing a dye layer comprising a cyan dye dispersed in a polymeric binder, said cyan dye comprising a 2-carbamoyl-4-[N-(p-substituted aminoaryl)imino]-1,4-naphthoquinone.

2. The element of claim 1 wherein said cyan dye has the formula:

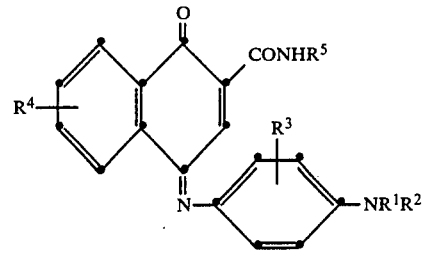

wherein $R^1$, $R^2$, and $R^5$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms; and $R^3$ and $R^4$ are each independently hydrogen; substituted or unsubstituted alkyl of from 1 to about 6 carbon atoms; halogen; —NHCOR$^1$ or —NH-SO$_2$R$^1$.

3. The element of claim 2 wherein $R^5$ is methyl.

4. The element of claim 2 wherein both $R^1$ and $R^2$ are ethyl.

5. The element of claim 2 wherein $R^4$ is hydrogen and $R^3$ is hydrogen or methyl.

6. The element of claim 5 wherein $R^5$ is methyl and both $R^1$ and $R^2$ are ethyl.

7. The element of claim 2 wherein a dye-barrier layer is located between said dye layer and said support.

8. The element of claim 1 wherein the side of the support opposite the side bearing said dye layer is coated with a slipping layer comprising a lubricating material.

9. The element of claim 1 wherein said support comprises poly(ethylene terephthalate).

10. The element of claim 1 wherein said dye layer comprises sequential repeating areas of magenta, yellow and said cyan dye.

11. In a process of forming a cyan dye transfer image comprising imagewise-heating a dye-donor element comprising a support bearing a dye layer comprising a cyan dye dispersed in a polymeric binder and transferring a cyan dye image to a dye-receiving element to form said cyan dye transfer image, the improvement wherein said cyan dye comprises a 2-carbamoyl-4-[N-(p-substituted aminoaryl)imino]-1,4-naphthoquinone.

12. The process of claim 11 wherein said cyan dye has the formula:

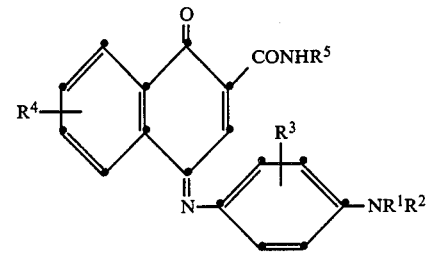

wherein $R^1$, $R^2$, and $R^5$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms; and $R^3$ and $R^4$ are each independently hydrogen; substituted or unsubstituted alkyl of from 1 to about 6 carbon atoms; halogen; —$NHCOR^1$ or —$NHSO_2R^1$.

13. The process of claim 11 wherein said support is poly(ethylene terephthalate) which is coated with sequential repeating areas of magenta, yellow and said cyan dye, and said process steps are sequentially performed for each color to obtain a three-color dye transfer image.

14. In a thermal dye transfer assemblage comprising:

(a) a cyan dye-donor element comprising a support bearing a dye layer comprising a cyan dye dispersed in a polymeric binder, and (b) a dye-receiving element comprising a support bearing a dye image-receiving layer, said dye-receiving element being in a superposed relationship with said cyan dye-donor element so that said dye layer is in contact with said dye image-receiving layer, the improvement wherein said cyan dye comprises a 2-carbamoyl-4-[N-(p-substituted aminoaryl-)imino]-1,4-naphthoquinone.

15. The assemblage of claim 14 wherein said cyan dye has the formula:

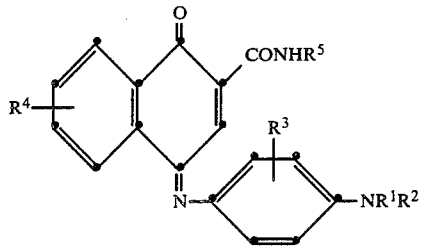

wherein $R^1$, $R^2$, and $R^5$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms; and $R^3$ and $R^4$ are each independently hydrogen; substituted or unsubstituted alkyl of from 1 to about 6 carbon atoms; halogen; —$NHCOR^1$ or —$NHSO_2R^1$.

16. The assemblage of claim 15 wherein $R^5$ is methyl.

17. The assemblage of claim 15 wherein both $R^1$ and $R^2$ are ethyl.

18. The assemblage of claim 15 wherein $R^4$ is hydrogen and $R^3$ is hydrogen or methyl.

19. The assemblage of claim 15 wherein both $R^1$ and $R^2$ are ethyl.

20. The assemblage of claim 14 wherein said support of the dye-donor element comprises poly(ethylene terephthalate).

* * * * *

REEXAMINATION CERTIFICATE (1227th)

United States Patent [19] [11] B1 4,695,287

Evans et al. [45] Certificate Issued Mar. 27, 1990

[54] CYAN DYE-DONOR ELEMENT USED IN THERMAL DYE TRANSFER

[75] Inventors: Steven Evans, Rochester; Kin K. Lum, Webster, both of N.Y.

[73] Assignee: Eastman Kodak Company, Rochester, N.Y.

Reexamination Request:
No. 90/001,638, Nov. 16, 1988

Reexamination Certificate for:

| | |
|---|---|
| Patent No.: | **4,695,287** |
| Issued: | **Sep. 22, 1987** |
| Appl. No.: | **911,839** |
| Filed: | **Sep. 26, 1986** |

Related U.S. Application Data

[63] Continuation-in-part of Ser. No. 813,209, Dec. 24, 1985, abandoned.

[51] Int. Cl.[4] ..... B41M 5/035; B41M 5/26

[52] U.S. Cl. ..... 8/471; 427/146; 427/256; 428/195; 428/207; 428/411.1; 428/480; 428/913; 428/914; 430/945; 503/227

[58] Field of Search ..... 8/470, 471; 427/146, 427/256; 428/195, 207, 411.1, 480, 488.1, 488.4, 913, 914; 430/945; 503/227

[56] References Cited

U.S. PATENT DOCUMENTS

| | | | |
|---|---|---|---|
| 3,342,597 | 9/1967 | Harnish et al. | 8/471 |
| 4,614,521 | 9/1986 | Niwa et al. | 8/471 |

FOREIGN PATENT DOCUMENTS

| | | | |
|---|---|---|---|
| 59-107258 | 7/1984 | Japan | 503/227 |
| 59-124890 | 7/1984 | Japan | 503/227 |
| 59-156791 | 9/1984 | Japan | 503/227 |
| 59-182839 | 10/1984 | Japan | 503/227 |
| 59-196291 | 11/1984 | Japan | 503/227 |
| 60-239289 | 11/1985 | Japan | 8/471 |

OTHER PUBLICATIONS

Miyagawa, *The Journal of the Japanese Society of Photography*, vol. 38, No. 3, 1975.

*Primary Examiner*—Bruce H. Hess

[57] ABSTRACT

A cyan dye-donor element for thermal dye transfer comprises a support having thereon a cyan dye dispersed in a polymeric binder, the cyan dye comprising a 2-carbamoyl-4-[N-(p-substituted aminoaryl)imino]-1,4-naphthoquinone.

In a preferred embodiment, the cyan dye has the formula

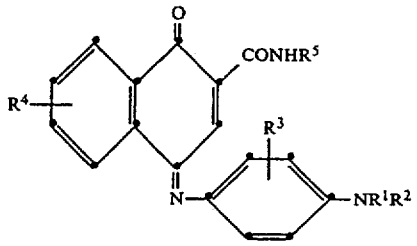

wherein $R^1$, $R^2$, and $R^5$ are substituted or unsubstituted alkyl, cycloalkyl, or aryl; and $R^3$ and $R^4$ are hydrogen; substituted or unsubstituted alkyl; halogen; —$NHCOR^1$ or —$NHSO_2R^1$.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 12 and 15 are cancelled.

Claims 1, 3–5, 7, 11, 14 and 16–19 are determined to be patentable as amended.

Claims 6, 8–10, 13 and 20, dependent on an amended claim, are determined to be patentable.

1. A cyan dye-donor element for thermal dye transfer comprising a support bearing a dye layer comprising a cyan dye dispersed in a polymeric binder, said cyan dye [comprising a2-carbamoyl-4-[N-(p-substituted aminoaryl)imino]-1,4-naphthoquinone] *having the formula:*

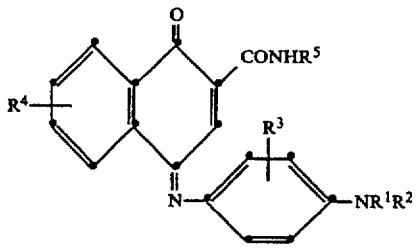

*wherein*

*$R^1$ and $R^2$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms;*

*$R^5$ is substituted or unsubstituted alkyl wherein the total number of carbon atoms is from 1 to about 7; substituted or unsubstituted cycloalkyl of from about 5 to about 7 carbon atoms; or substituted or unsubstituted aryl of from about 5 to about 10 carbon atoms; and*

*$R^3$ and $R^4$ are each independently hydrogen; substituted or unsubstituted alkyl of from 1 to about 6 carbon atoms; halogen; —$NHCOR^1$ or —$NHSO_2R^1$,*

*said dye not having any group capable of reacting with an active hydrogen compound in an image-receiving layer.*

3. The element of claim [2] *1* wherein $R^5$ is methyl.

4. The element of claim [2] *1* wherein both $R^1$ and $R^2$ are ethyl.

5. The element of claim [2] *1* wherein $R^4$ is hydrogen and $R^3$ is hydrogen or methyl.

7. The element of claim [2] *1* wherein a dye-barrier layer is located between said dye layer and said support.

11. In a process of forming a cyan dye transfer image comprising imagewise-heating a dye-donor element comprising a support bearing a dye layer comprising a cyan dye dispersed in a polymeric binder and transferring a cyan dye image to a dye-receiving element to form said cyan dye transfer image, the improvement wherein said cyan dye [comprises a 2-carbamoyl-4-[N-(p-substituted aminoaryl)imino]-1,4-naphthoquinone] *has the formula:*

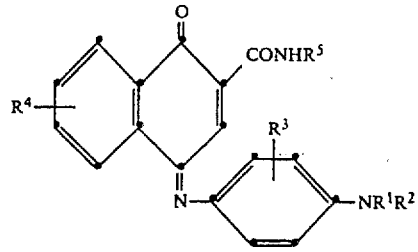

*wherein*

*$R^1$ and $R^2$ are each independently substituted or unsubstituted alkyl of from 1 to about 6 carbon atoms; substituted or unsubstituted cycloalkyl of from about 5 to about 7 carbon atoms; or substituted or unsubstituted aryl of from about 5 to about 10 carbon atoms;*

*$R^5$ is substituted or unsubstituted alkyl wherein the total number of carbon atoms is from 1 to about 7; substituted or unsubstituted cycloalkyl of from about 5 to about 7 carbon atoms; or substituted or unsubstituted aryl of from about 5 to about 10 carbon atoms; and*

*$R^3$ and $R^4$ are each independently hydrogen; substituted or unsubstituted alkyl of from 1 to about 6 carbon atoms; halogen; —$NHCOR^1$ or —$NHSO_2R^1$,*

*said dye not having any group capable of reacting with an active hydrogen compound in an image-receiving layer.*

14. In a thermal dye transfer assemblage comprising:

(a) a cyan dye-donor element comprising a support bearing a dye layer comprising acyan dye dispersed in a polymeric binder, and (b) a dye-receiving element comprising a support bearing a dye image-receiving layer, said dye-receiving element being in a superposed relationship with said cyan dye-donor element so that said dye layer is in contact with said dye image-receiving layer, the improvement wherein said cyan dye [comprises a 2-carbamoyl-4-[N-(p-substituted aminoaryl-)imino]-1,4-naphthoquinone] *has the formula:*

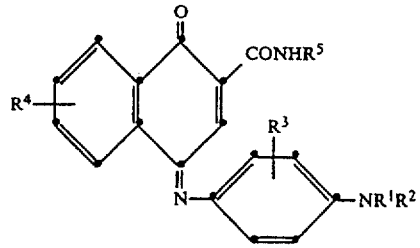

*wherein*

*$R^1$ and $R^2$ are each independently substituted or unsubstituted alkyl of from 1 to about 6 carbon atoms; substituted or unsubstituted cycloalkyl of from about 5 to about 7 carbon atoms; or substitutedor unsubstituted aryl of from about 5 to about 10 carbon atoms;*

*$R^5$ is substituted or unsubstituted alkyl wherein the total number of carbon atoms is from 1 to about 7; substituted or unsubstituted cycloalkyl of from about 5 to*

*about 7 carbon atoms; or substituted or unsubstituted aryl of from about 5 to about 10 carbon atoms; and*

*$R^3$ and $R^4$ are each independently hydrogen; substituted or unsubstituted alkyl of from 1 to about 6 carbon atoms; halgoen; —NHCOR$^1$ or —NHSO$_2$R$^1$,*

*said dye not having any group capable of reacting with an active hydrogen compound in an image-receiving layer.*

16. The assemblage of claim [15] *14* wherein $R^5$ is methyl.

17. The assemblage of claim [15] *14* wherein both $R^1$ and $R^2$ are ethyl.

18. The assemblage of claim [15] *14* wherein $R^4$ is hydrogen and $R^3$ is hydrogen or methyl.

19. The assemblage of claim [15] *14* wherein both $R^1$ and $R^2$ are ethyl.

* * * * *